US010222729B2

(12) United States Patent
Takagi

(10) Patent No.: US 10,222,729 B2
(45) Date of Patent: Mar. 5, 2019

(54) FIXING DEVICE AND IMAGE FORMING APPARATUS

(71) Applicant: KYOCERA Document Solutions Inc., Osaka (JP)

(72) Inventor: Masaru Takagi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/896,427

(22) Filed: Feb. 14, 2018

(65) Prior Publication Data

US 2018/0239280 A1 Aug. 23, 2018

(30) Foreign Application Priority Data

Feb. 21, 2017 (JP) ..... 2017-030067

(51) Int. Cl.
*G03G 15/20* (2006.01)
*G03G 21/16* (2006.01)
(Continued)

(52) U.S. Cl.
CPC ..... *G03G 15/2017* (2013.01); *G03G 9/0821* (2013.01); *G03G 15/0291* (2013.01);
(Continued)

(58) Field of Classification Search
CPC ..... G03G 15/2017; G03G 15/2028; G03G 15/0291
See application file for complete search history.

(56) References Cited

U.S. PATENT DOCUMENTS 4,935,785 A * 6/1990 Wildi ..... G03G 15/2057 399/171
5,307,132 A * 4/1994 Tsuchiya ..... G03G 15/0258 399/70

(Continued)

FOREIGN PATENT DOCUMENTS

DE 34 09 999 A1 9/1984
JP 04109279 A * 4/1992
JP 2000-305388 A 11/2000

OTHER PUBLICATIONS

Machine Translation of JP H04-109279. Apr. 10, 1992. (Year: 1992).*

(Continued)

*Primary Examiner* — Carla J Therrien
(74) *Attorney, Agent, or Firm* — Studebaker & Brackett PC

(57) ABSTRACT

A fixing device includes a heating body, a pressuring body, a heating source, a guiding part, a temperature sensing part and a charging part. The heating source supplies the heating body heat used for heating the medium. The guiding part guides the medium to a nip between the heating body and the pressuring body, at an upstream side from the nip in a conveying direction of the medium. The temperature sensing part senses a temperature of the heating body. The charging part electrically discharges to electrically charge the heating body with the same polarity as toner, at an opposite side to the guiding part across the temperature sensing part. The charging part includes a discharging electrode electrically discharging toward the heating body facing to the discharging electrode and an enclosure wall supporting the discharging electrode, enclosing the discharging electrode and producing an electric field in cooperation with the discharging electrode.

16 Claims, 14 Drawing Sheets

(51) Int. Cl.
*G03G 15/02* (2006.01)
*G03G 9/08* (2006.01)

(52) U.S. Cl.
CPC ..... *G03G 15/2014* (2013.01); *G03G 15/2028* (2013.01); *G03G 21/1685* (2013.01); *G03G 2215/2006* (2013.01)

(56) References Cited

U.S. PATENT DOCUMENTS

| | | | | |
|---|---|---|---|---|
| 2007/0140753 | A1* | 6/2007 | Berkes | G03G 15/2053 399/324 |
| 2012/0134724 | A1* | 5/2012 | Kageyama | G03G 15/1625 399/329 |
| 2013/0071136 | A1* | 3/2013 | Gon | G03G 15/2053 399/94 |
| 2014/0270833 | A1 | 9/2014 | Yuasa et al. | |
| 2017/0023874 | A1* | 1/2017 | Hanano | G03G 15/0225 |
| 2017/0299989 | A1* | 10/2017 | Nakano | G03G 15/0216 |
| 2017/0308010 | A1* | 10/2017 | Okajima | G03G 15/2053 |
| 2018/0032011 | A1* | 2/2018 | Nanjo | G03G 15/2064 |
| 2018/0173152 | A1* | 6/2018 | Nakajima | G03G 15/2025 |
| 2018/0196382 | A1* | 7/2018 | Kasama | G03G 15/2028 |
| 2018/0217532 | A1* | 8/2018 | Kikuchi | G03G 15/205 |

OTHER PUBLICATIONS

The extended European search report issued by the European Patent Office dated Sep. 5, 2018, which corresponds to European Patent Application No. 18155474.2-1022 and is related to U.S. Appl. No. 15/896,427.

* cited by examiner

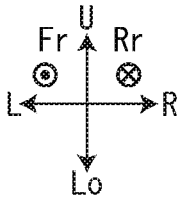
FIG. 5
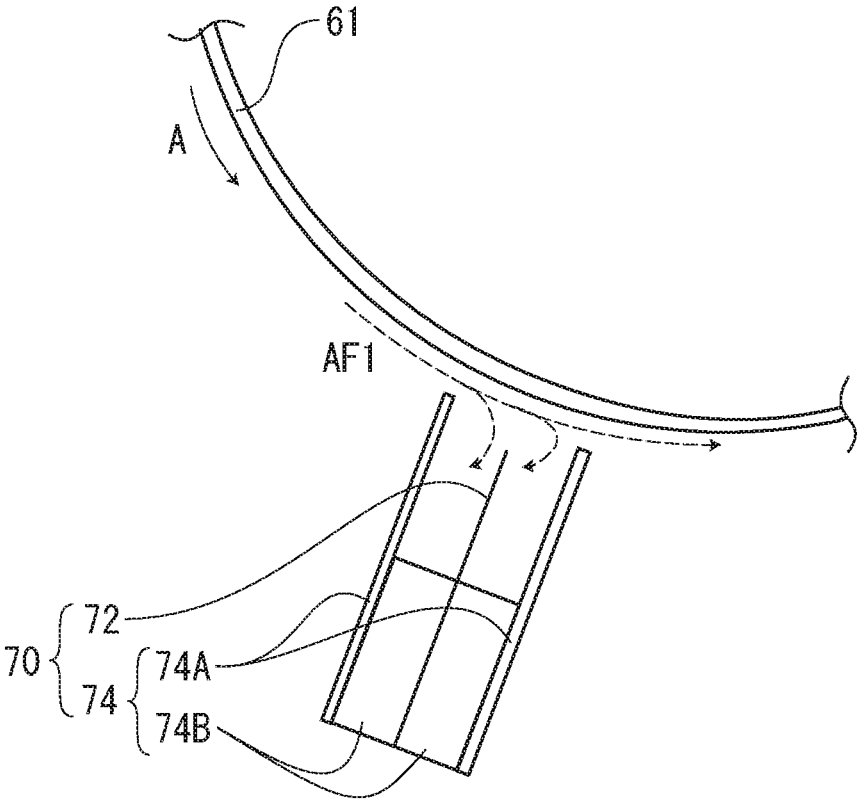

FIXING DEVICE AND IMAGE FORMING APPARATUS

INCORPORATION BY REFERENCE

This application is based on and claims the benefit of priority from Japanese Patent application No. 2017-030067 filed on Feb. 21, 2017, the entire contents of which are incorporated herein by reference.

BACKGROUND

The present disclosure relates to a fixing device and an image forming apparatus.

For example, a fixing device including a rotating body having a heating source, a pressuring member forming a pressure contact part in cooperation with a surface of the rotating body and an inlet guide is known to cause the pressure contact part (corresponding to a nip) to sandwich and to convey a recording material conveyed while coming into contact with the inlet guide (corresponding to a guiding part) and to thermally fix, onto the recording material, a toner image electrostatically adhered and formed on a surface of the recording material. Moreover, in the fixing device, a charging means (a corotron charger) electrically charging the surface of the rotating body with the same polarity as that of a toner is provided. The charging means provided in the fixing device restrains occurrence of electrostatic offset.

Incidentally, in the above-mentioned fixing device, for example, ions generated by the electric discharge of the charging means may reach the inlet guide and cause the inlet guide to be charged. As a result, when a medium to be conveyed comes into contact with the charged inlet guide (the guiding part), the medium may be charged and prevented from being guided to the pressure contact part (the nip).

SUMMARY

In accordance with the present disclosure, a fixing device includes a heating body, a pressuring body, a heating source, a guiding part, a temperature sensing part and a charging part. The heating body is formed in a tube-like shape and, while rotating, heats a medium conveyed after a toner image is formed on the medium. The pressuring body is formed in a tube-like shape and, while rotating, forms a nip in cooperation with the heating body and pressures the medium by sandwiching the medium in cooperation with the heating body at the nip. The heating source supplies the heating body heat used when the heating body heats the medium. The guiding part is positioned at an upstream side in a conveying direction of the medium with respect to the nip and guides the medium being conveyed to the nip. The temperature sensing part is positioned to face to the heating body and senses a temperature of the heating body. The charging part is positioned at an opposite side to the guiding part across the temperature sensing part, is configured as a corotron type charging part electrically discharging to electrically charge the heating body with the same polarity as polarity of toner. The charging part includes a discharging electrode electrically discharging toward the heating body facing to the discharging electrode and an enclosure wall supporting the discharging electrode, enclosing the discharging electrode and producing an electric field in cooperation with the discharging electrode.

In accordance with the present disclosure, an image forming apparatus includes a forming part forming a toner image onto a medium and the above-described fixing device fixing the toner image formed on the medium by the forming part onto the medium.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 5 is a transverse sectional view showing a fixing device according to another comparison form, together with airflow generated in the periphery of a charging device body in the fixing operation.

DETAILED DESCRIPTION

Figure 1:
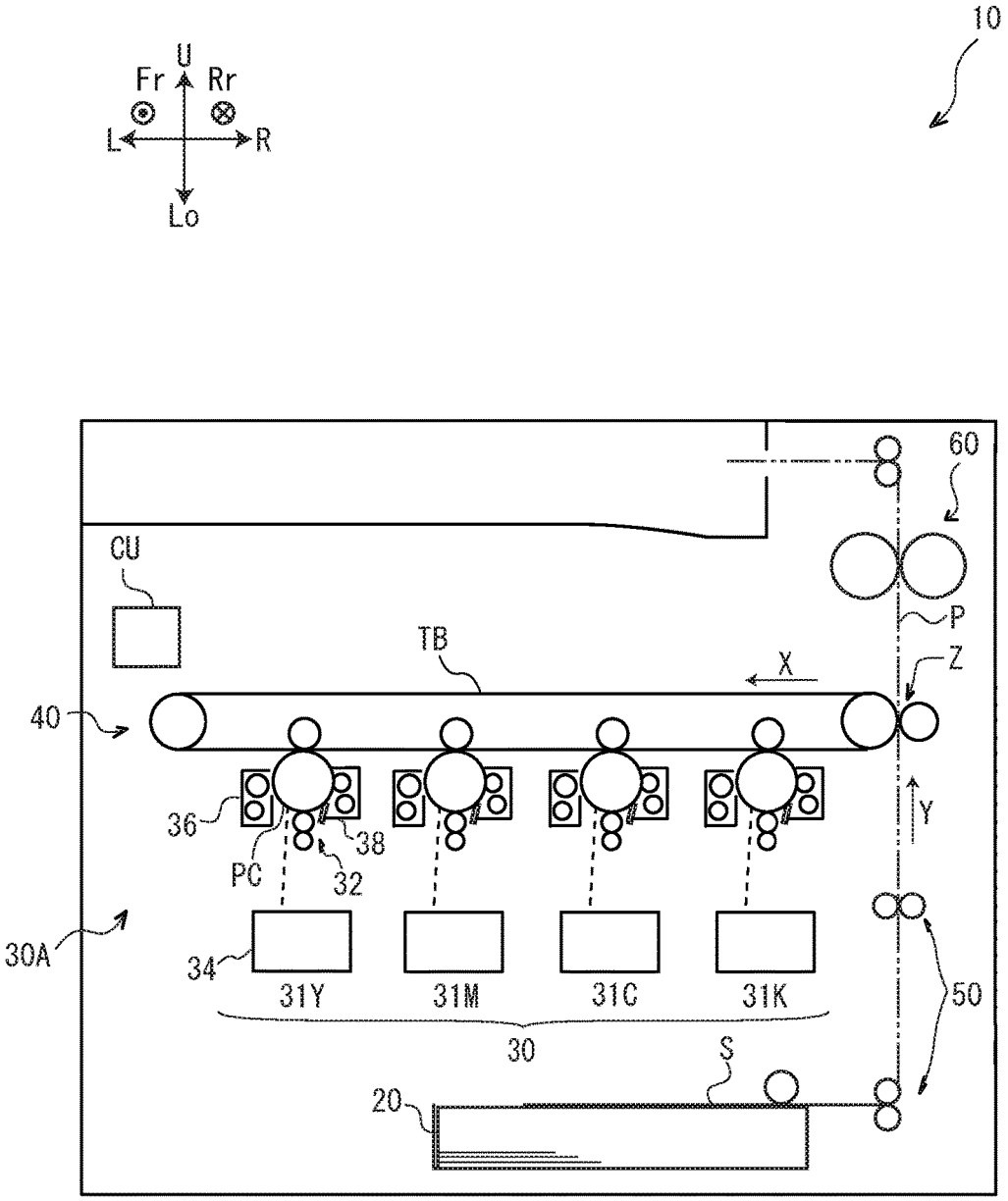
FIG. 1 is a sectional view schematically showing the image forming apparatus, as viewed from a front side, according to an embodiment of the present disclosure.

Hereinafter, entire structure and image forming operation of an image forming apparatus 10 (refer to FIG. 1) of an embodiment according to the present disclosure, structure and fixing operation of a fixing device 60 (refer to FIGS. 3A and 3B) as a main component of the present embodiment, and effects and modified examples of the present embodiment will be described in order.

In the present specification, arrows Fr and Rr in the drawings respectively correspond to a near side and a far side in an apparatus depth direction, arrows R and L in the drawings respectively correspond to a right side and a left side in an apparatus width direction, and arrows U and Lo in the drawings respectively correspond to an upper side and a lower side in an apparatus height direction. The specification will be described so that a state of the image forming apparatus 10 as viewed from the near side in the apparatus depth direction is estimated to be a front side of the image forming apparatus 10.

The entire structure of the image forming apparatus 10 will be described with reference to FIG. 1. The image forming apparatus 10 is an electrographic type apparatus configured to include a sheet feeding cartridge 20, a toner image forming part 30, a transferring device 40, a conveying device 50, the fixing device 60 and controlling part CU.

The sheet feeding cartridge 20 has a function storing mediums S.

The toner image forming part 30 has functions performing respective processes of electric charging, exposing and developing to form a toner image carried on a belt TB described later. The toner image forming part 30 is composed of monochrome units 31Y, 31M, 31C and 31K forming toner images of different colors (yellow (Y), magenta (M), cyan (C) and black (K). The monochrome units 31Y, 31M, 31C and 31K includes respective photosensitive bodies PC, respective charging devices 32, respective exposing devices 34, respective developing devices 36 and respective cleaning devices 38.

The photosensitive body PC is formed in a drum-like shape and configured so as to be rotated in a clockwise direction as viewed from the front side by being driven with a driving source (not shown), while carrying a latent image formed by the exposing device 34. The charging device 32 has a function electrically charging the photosensitive body PC by a voltage applied from a power supply (not shown). The developing device 36 has a function developing the latent image, which is formed on the photosensitive body PC by the exposing device 34, to the toner image by using toner (not shown). The cleaning device 38 has a function removing residual toner remaining on the photosensitive body PC (toner remaining adhered to the photosensitive body PC without being transferred after transferring the toner image to the belt TB) from the photosensitive body PC. Incidentally, in the present embodiment, an average of a charge amount (an average charge) of the toner (not shown) composing the toner image has, as one example, positive polarity.

Respective components, except for the photosensitive body PC, composing the toner image forming part 30 are positioned around the photosensitive body PC in a clockwise direction as viewed from the front side in the order of the charging device 32, the developing device 36, a static eliminator (not shown) and the cleaning device 38. The exposing device 34 forms the latent image on the photosensitive body PC between the charging device 32 and the developing device 36. Incidentally, in FIG. 1, respective reference numerals of the components composing the monochrome units 31M, 31C and 31K except for the monochrome unit 31Y are omitted.

The transferring device 40 includes the endless belt TB and has functions primarily transferring the toner image formed by the toner image forming part 30 to the belt TB rotating in the direction of an arrow X in FIG. 1 and secondarily transferring the toner image carried on the belt TB to the medium S. Incidentally, in the present embodiment, combination of the toner image forming part 30 and the transferring device 40 is called as a forming part 30A. In other words, the forming part 30A has a function forming the toner image on the medium S.

The conveying device 50 has a function conveying the medium S stored in the sheet feeding cartridge 20 along a conveying path (a chain double-dashed line P in FIG. 1). Incidentally, an arrow Y in FIG. 1 indicates a conveying direction of the medium S.

The fixing device 60 has a function fixing the toner image secondarily transferred on the medium S by the transferring device 40, that is, the toner image formed on the medium S by the forming part 30A, to the medium S. The fixing device 60 will be described later.

Figure 2:
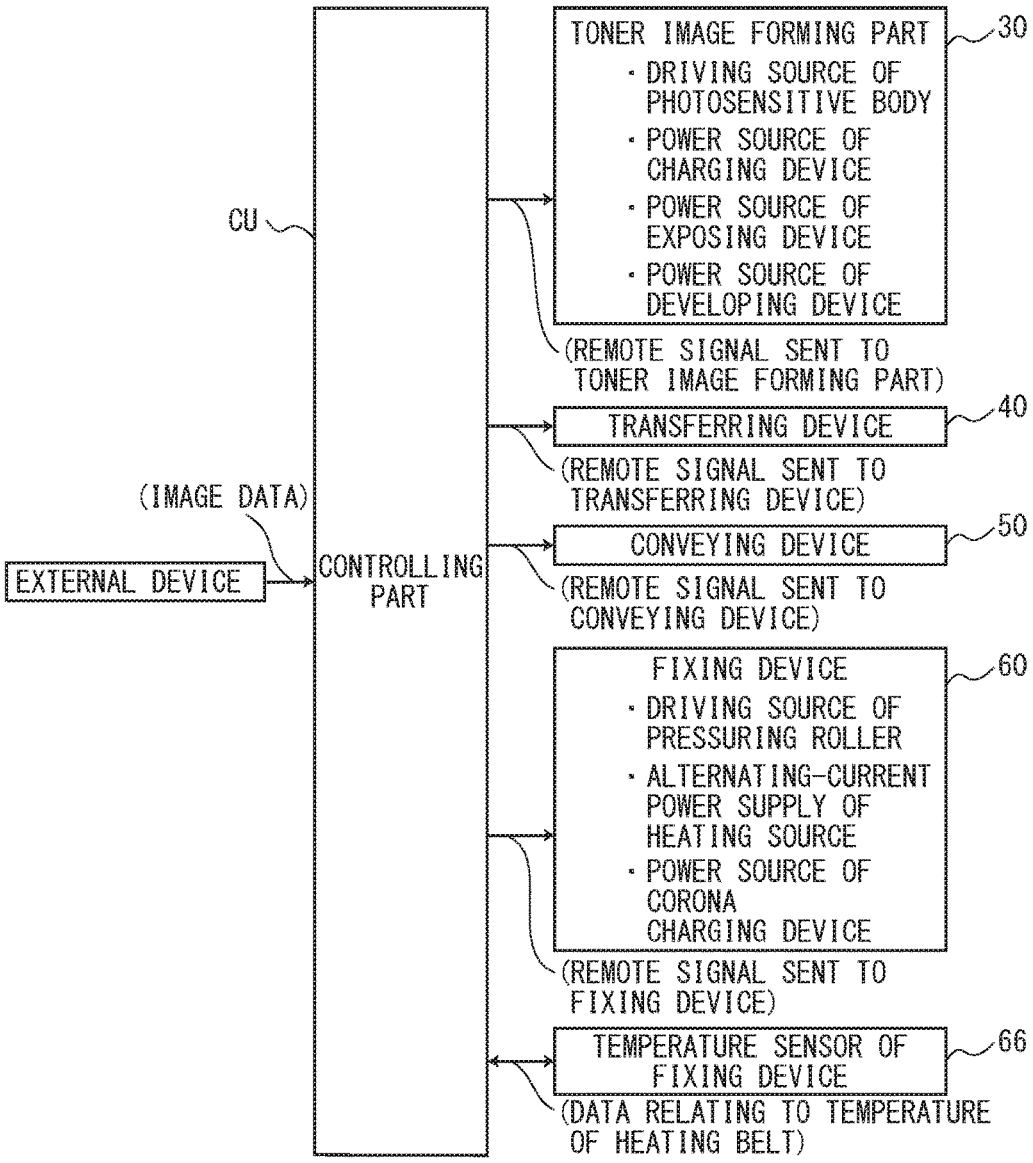
FIG. 2 is a block diagram showing a relationship of a controlling part composing the image forming apparatus according to the present embodiment and components composing the image forming apparatus.

The controlling part CU has a function controlling respective components composing the image forming apparatus 10 (refer to FIG. 2). The function of the controlling part CU will be described in the following explanation of an image forming operation and a fixing operation described later.

Next, the image forming operation of the image forming apparatus 10 in accordance with the present embodiment will be described with reference to FIGS. 1 and 2.

The controlling part CU operates the respective components of the image forming apparatus 10 when receiving image data from an external device (refer to FIG. 2).

When the toner image forming part 30 is operated, in each of the monochrome units 31Y, 31M, 31C and 31K, the charging device 32 electrically charges the photosensitive body PC, the exposing device 34 exposes the photosensitive body PC (forms the latent image on the photosensitive body PC), and the developing device 36 develops the latent image on the photosensitive body PC to the toner image. As a result, the toner image is formed on each photosensitive body PC.

Subsequently, when the transferring device 40 and the conveying device 50 are operated, the toner image formed by the toner image forming part 30 is primarily transferred to the belt TB. Further, the medium S stored in the sheet feeding cartridge 20 is conveyed by the conveying device 50 to a secondary transfer position in accordance with timing when the toner image primarily transferred to the belt TB reaches the secondary transfer position (refer to a position represented by a sign Z in FIG. 1), and the toner image on the belt TB is secondarily transferred to the medium S. The medium S, on which the toner image is secondarily transferred, is conveyed to the fixing device 60 by the conveying device 50.

Subsequently, the fixing device 60 is operated and the medium S, on which the toner image is secondarily transferred (on which the toner image is formed by the forming part 30A), is conveyed to the fixing device 60, and then, the toner image on the medium S is fixed to the medium S (an image is formed on the medium S).

Consequently, the medium S, to which the toner image is fixed, is ejected to the outside of the image forming apparatus 10 by the conveying device 50 and the image forming operation is completed.

Next, the configuration of the fixing device 60 being a main component in the present embodiment will be described in detail with reference to FIGS. 3A to 3I and 4 (mainly FIG. 3B).

Figure 3A:
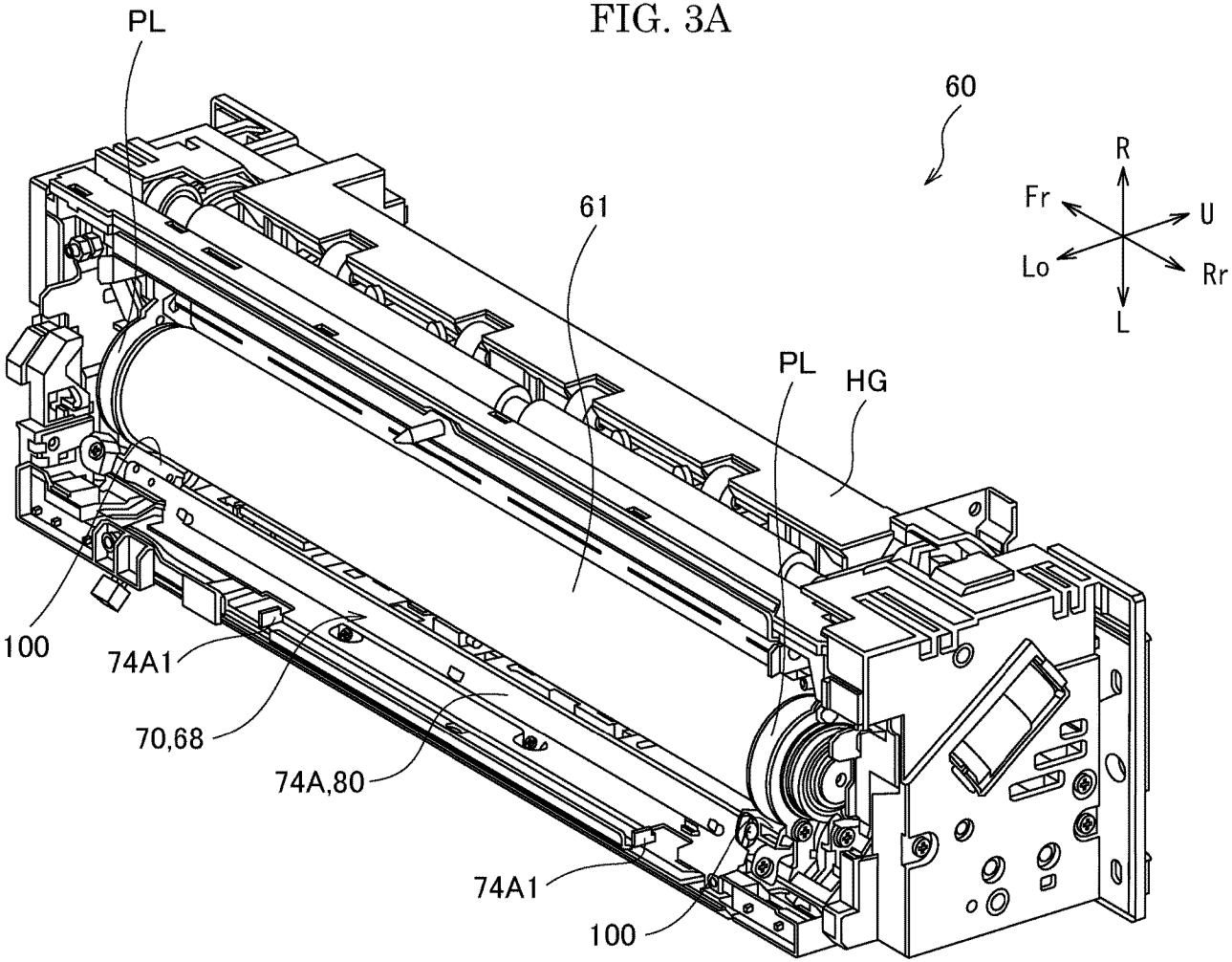
FIG. 3A is a perspective view showing a part of a fixing device composing the image forming apparatus according to the embodiment.
Figure 3B:
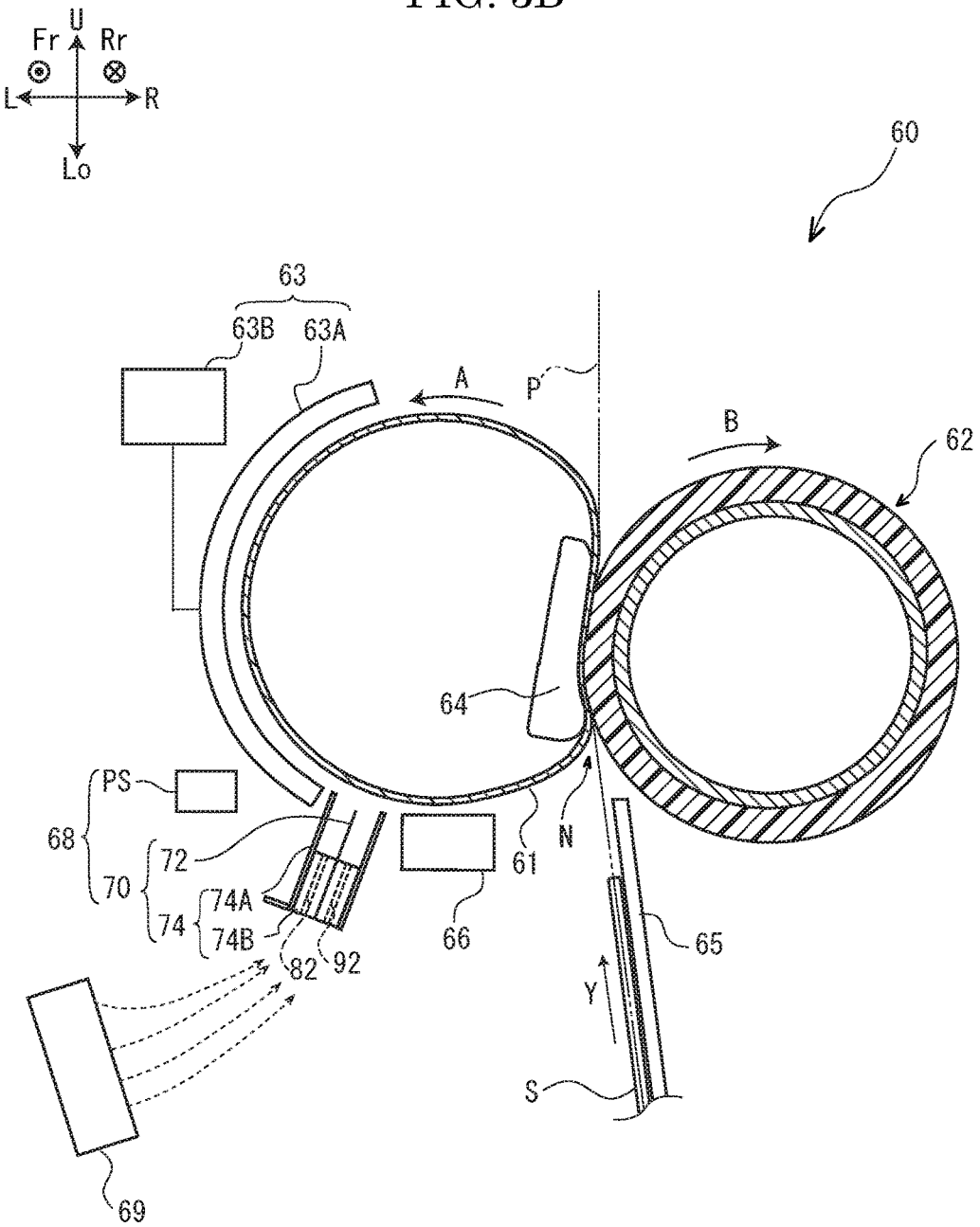
FIG. 3B is a transverse sectional view schematically showing the fixing device composing the image forming apparatus, as viewed from the front side, according to the present embodiment.

As shown in FIG. 3B, the fixing device 60 is configured to include a heating belt 61 (one example of a heating body), a pair of pulleys PL (refer to FIGS. 3A, 3I and other figures), a pressuring roller 62 (one example of a pressuring body), a heating source 63, a curving member 64, a guiding part 65, a temperature sensor 66 (one example of a temperature sensing part), a corona charging device 68, a blowing fan 69 (one example of a blowing part), a housing HG (refer to FIGS. 3A, 3H and other figures), and a pair of side plates (not shown). The heating belt 61, the pressuring roller 62 and an induction coil 63A composing the heating source 63 described later are formed in elongated shapes and positioned to the pair of side plates in a state that their longitudinal directions are arranged along the apparatus depth direction. Then, the fixing device 60 is formed in an elongated shape and attached to a main body of the image forming apparatus 10 in a state that its longitudinal direction is arranged along the apparatus depth direction.

The heating belt 61 has a function heating the medium S and the toner image (the toner used for forming the toner image) formed on the medium S by the forming part 30A while rotating. The heating belt 61 is, as shown in FIG. 3B, a tube-like belt, that is, an endless belt.

The heating belt 61 is configured to receive heat from the heating source 63 described later and to be rotated by following the pressuring roller 62. An arrow A in FIG. 3B indicates a rotating direction of the heating belt 61. The heating belt 61 is configured to sandwich and to pressure the medium S, on which the toner image is formed, conveyed by the conveying device 50 in cooperation with the pressuring roller 62 at a nip N described later. As a result, the heating belt 61 is configured to come into contact with the medium S, on which the toner image is formed, while rotating, to heat the medium S and to pressure the medium S in cooperation with the pressuring roller 62, thereby fixing the toner image on the medium S.

Figure 3C:
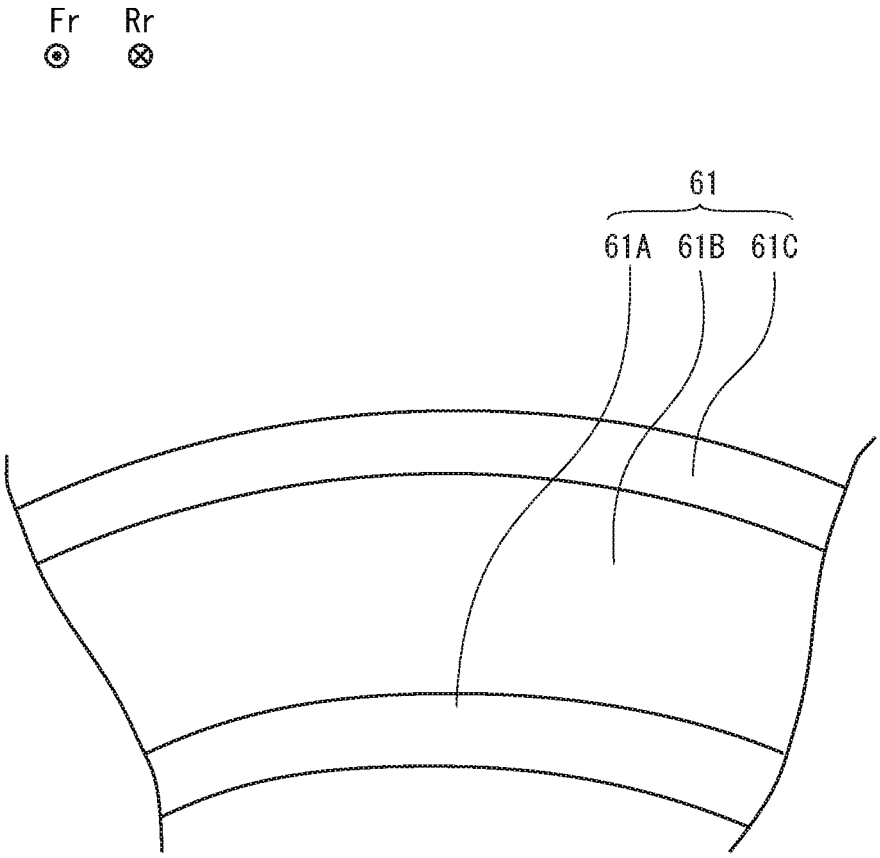
FIG. 3C is a partial sectional view showing a heating belt composing the fixing device according to the present embodiment.

The heating belt 61 has, as one example, layer composition as follows. As shown in FIG. 3C, the heating belt 61 has three-layer structure composed of a heating layer 61A, an elastic layer 61B and a release layer 61C. The heating layer 61A is, as one example, a metallic layer and an inner face of the heating layer 61A constitutes an inner circumferential face of the heating belt 61. The heating layer 61A has a function generating heat by an action of electromagnetic induction from the induction coil 63A of the heating source 63 described later. The elastic layer 61B covers an entire outer circumferential face of the heating layer 61A. The elastic layer 61B is, as one example, made of fluorine resin (fluorophenylalanine: PFA) having elasticity and insulation quality. The elastic layer 61B has a function facilitating elastic deformation of the heating layer 61. The release layer 61C is, as one example, a layer made of fluorine resin having insulation quality and covers an entire outer circumferential face of the elastic layer 61B. The release layer 61C has a function making the toner hard to be adhered when the toner comes into contact with the release layer 61C in the fixing operation. Incidentally, the heating belt 61 (the release layer 61C of the heating belt 61) of the present embodiment has a property of being electrically charged with negative polarity easily by coming into contact with the medium S. Thus, as the present embodiment, when the toner, of which the average charge has positive polarity, is used, the toner put on the medium S may be adhered to the heating belt 61, and then, electrostatic offset easily occurs. Incidentally, the heating layer 61A is grounded by being connected with the frame (not shown) of the main body of the image forming apparatus 10.

Figure 3D:
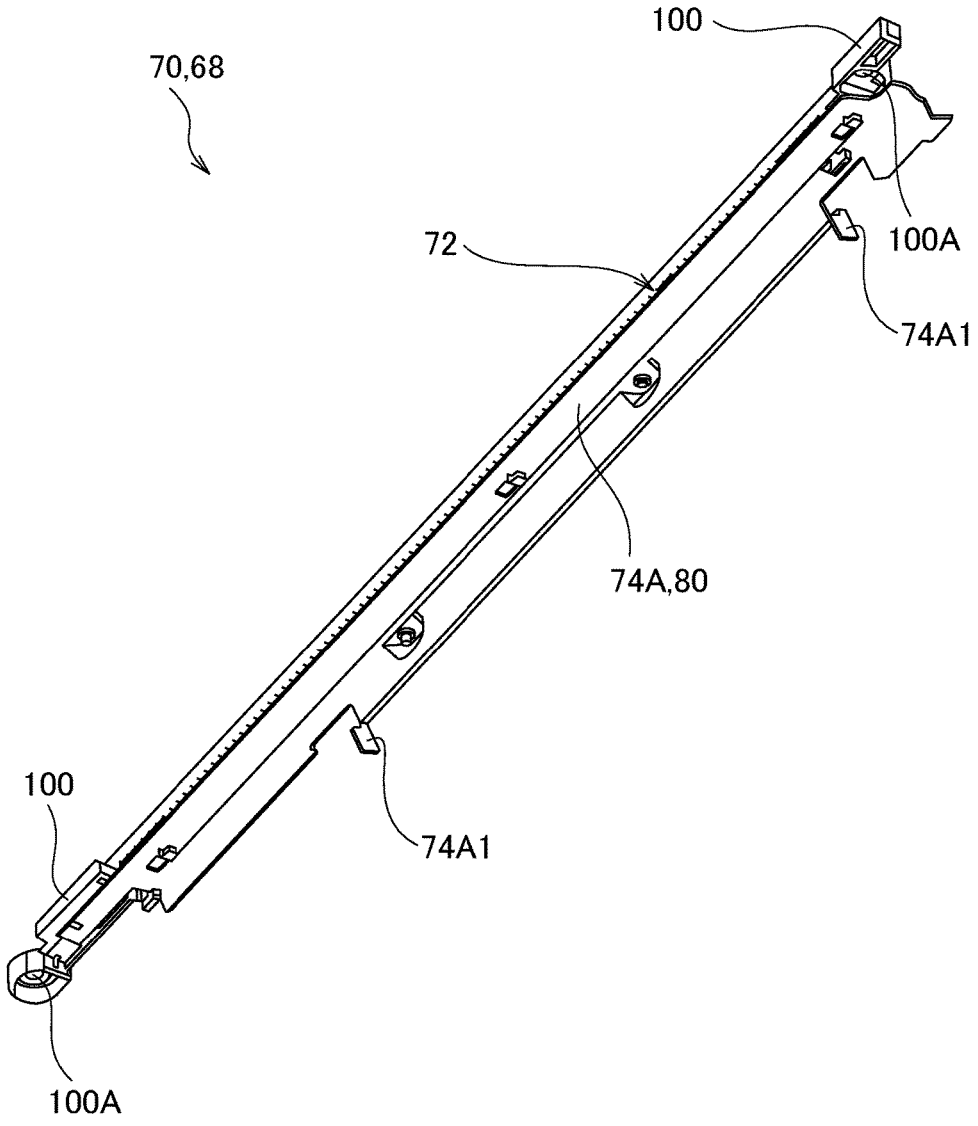
FIG. 3D is a perspective view showing a charging device body composing the fixing device of the image forming apparatus according to the present embodiment.
Figure 3E:
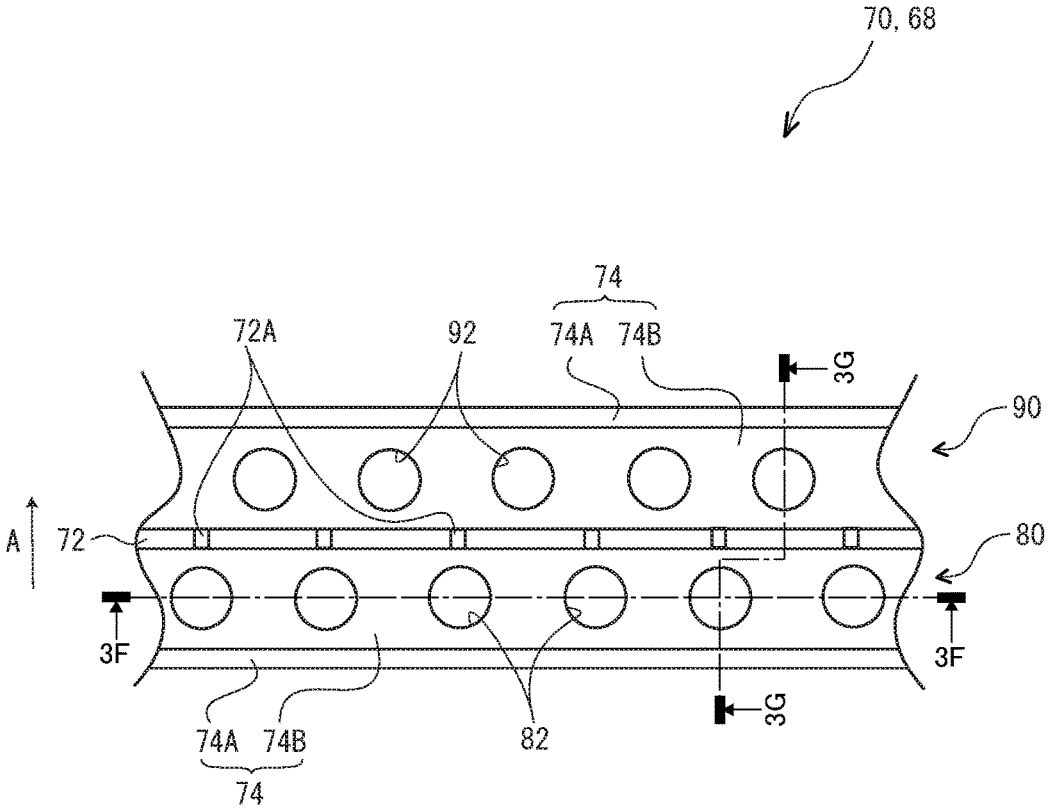
FIG. 3E is a plan view showing a part of the charging device body composing a corona charging device of the fixing device according to the present embodiment.
Figure 3F:
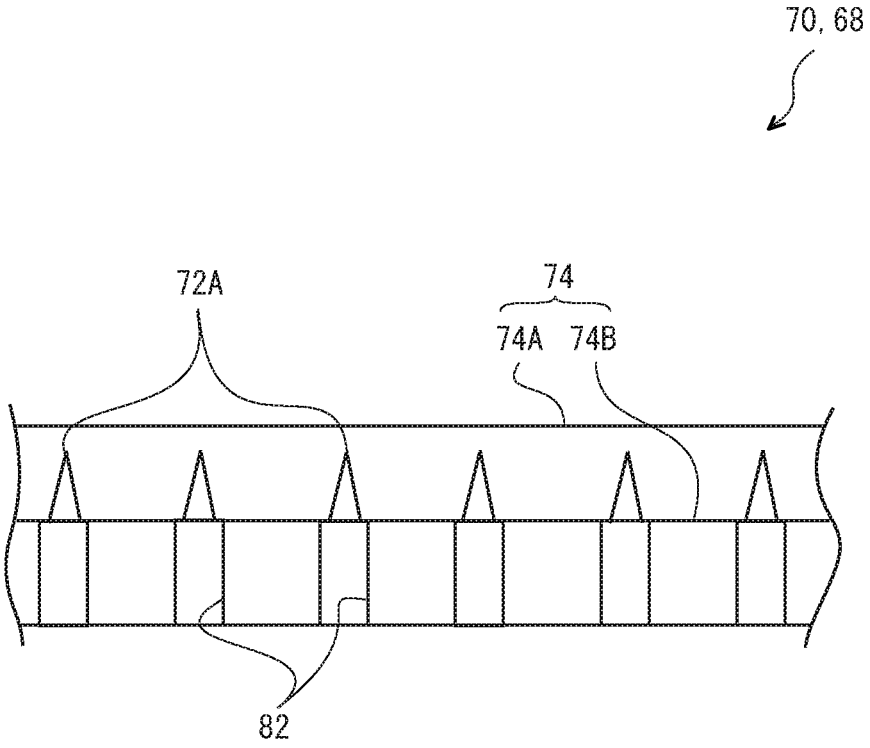
FIG. 3F is a sectional view taken along a 3F-3F line in FIG. 3E.
Figure 3G:
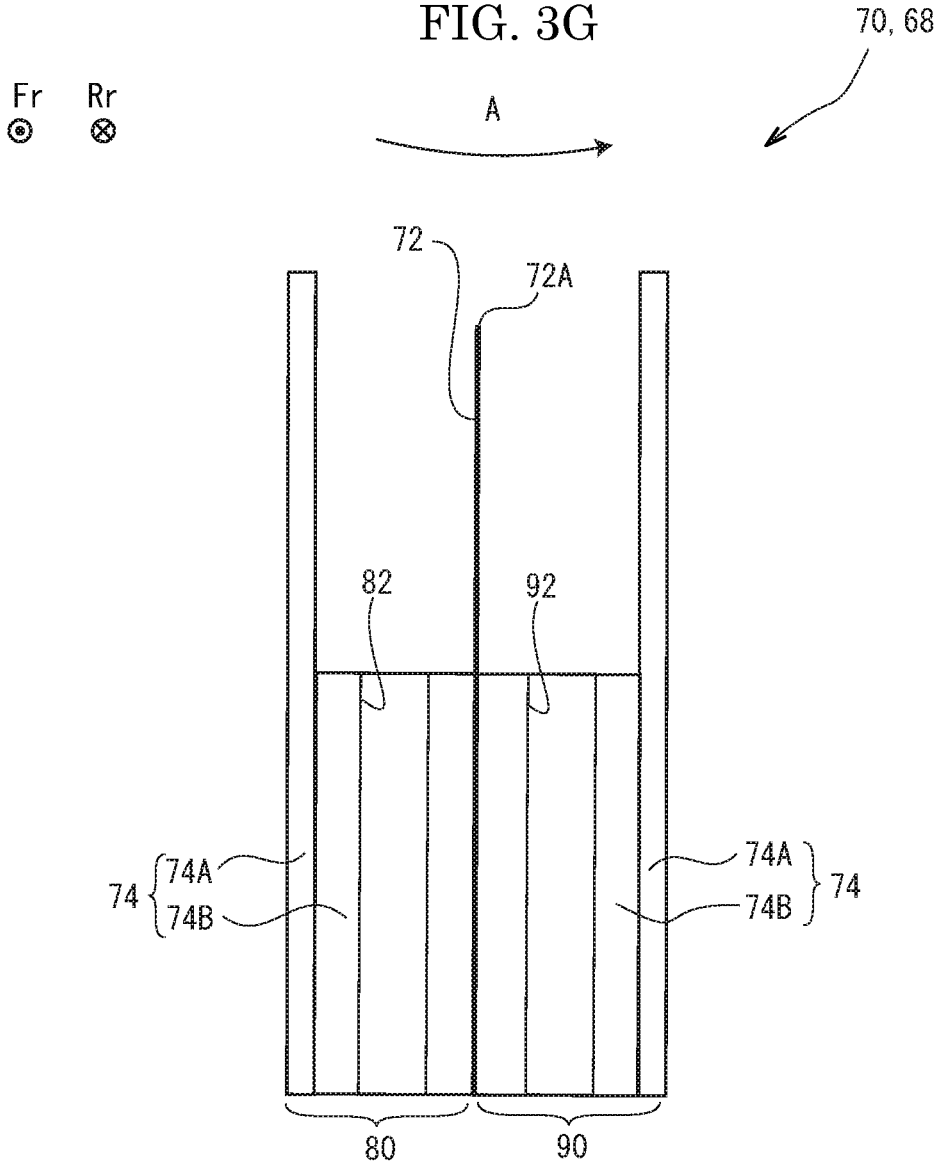
FIG. 3G is a sectional view taken along a 3G-3G line in FIG. 3E.
Figure 3H:
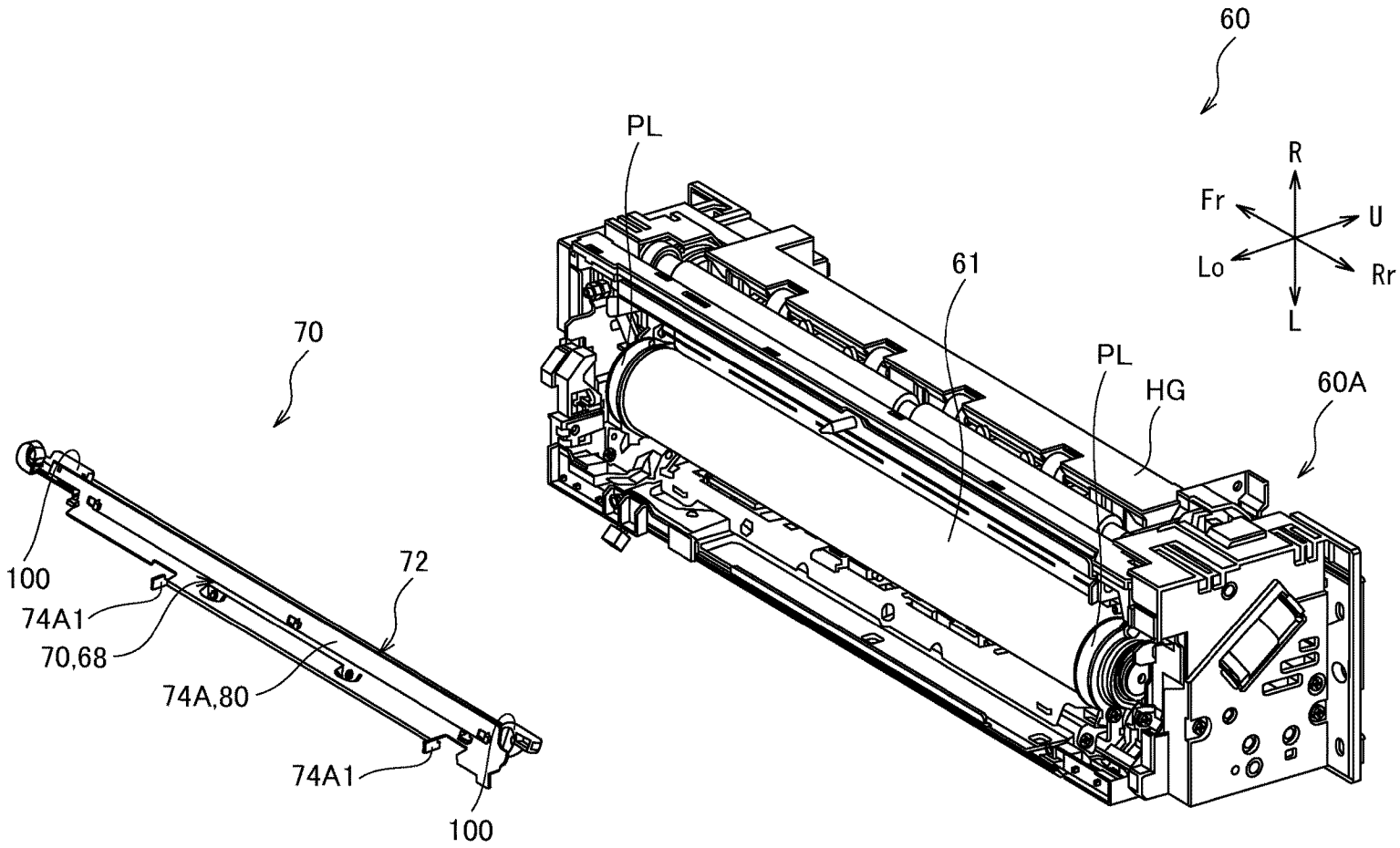
FIG. 3H is a perspective view showing the fixing device, in a state that the charging device body is removed from a fixing device body, of the image forming apparatus according to the present embodiment.
Figure 3I:
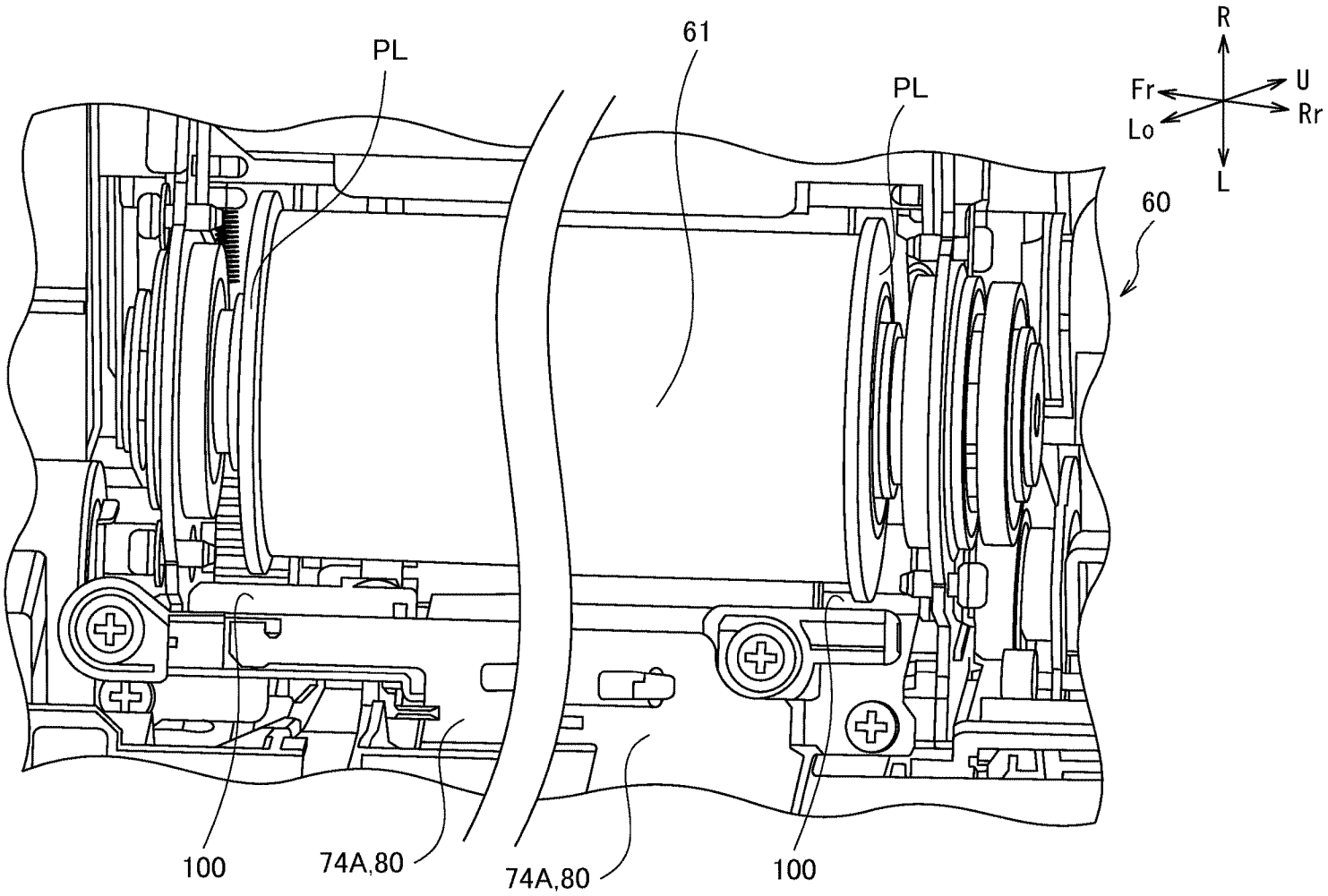
FIG. 3I is a perspective view showing a configuration of both ends of the fixing device composing the image forming apparatus according to the present embodiment.

Into both end portions of the heating belt 61, as shown in FIGS. 3A, 3H and 3I, the pair of pulleys PL are fitted. The respective pulleys PL are rotatably supported by a pair of side plates via a shaft (not shown) into which the respective pulleys are fitted. The respective pulleys PL are protruded from an outer circumference of the heating belt 61 in a radial direction over an entire circumference of the heating belt 61 (refer to FIG. 3A). Then, the pair of pulleys PL is configured to come into contact with both ends of the heating belt 61 moving in an axial direction in accordance with rotating around its axis, and thereby, to prevent the heating belt 61 from weaving.

The pressuring roller 62 is formed in a tube-like shape and has a function sandwiching and pressuring, in cooperation with the heating belt 61, the medium S and the toner image (the toner used for forming the toner image) formed on the medium S by the forming part 30A. The pressuring roller 62 is, as shown in FIG. 3B, positioned at a right side of the heating belt 61 as viewed from the device-depth direction. Moreover, in a state that the pressuring roller 62 and the heating belt 61 forms the nip N (refer to FIG. 3B), the pressuring roller 62 comes into contact with the heating belt 61 while a right side portion of the heating belt 61 is depressed by a left side portion of the pressuring roller 62. The nip N described above indicates a contact portion of the heating belt 61 and the pressuring roller 62 formed by the heating belt 61 and the pressuring roller 62. Incidentally, the pressuring roller 62 is configured to be rotated by being driven with a driving source (not shown). According to this, the pressuring roller 62 is configured to drive and to rotate the heating belt 61. An arrow B in FIG. 3B indicates the rotating direction of the pressuring roller 62.

The heating source 63 has a function applying heat used for heating the medium S by the heating belt 61 into the heating belt 61. The heating source 63 is configured, as shown in FIG. 3B, as one example, to include the induction coil 63A and an alternating-current power supply 63B. The induction coil 63A is positioned to face to the outer circumference of the heating belt 61 at a left side as viewed from the front side (at an opposite side to a side where the pressuring roller 62 is positioned, across the heating belt 61). That is, the induction coil 63A is formed in an arc shape as viewed from the front side. When viewed from another angle, the heating source 63 (the induction coil 63A of the heating source 63) faces to a portion at a downstream side in the rotating direction of the heating belt 61 with respect to the nip N and at an upstream side with respect to a charging device body 70 described later on the outer circumference of the heating belt 61. Incidentally, the induction coil 63A is configured to heat the heating belt 61 by an action of electromagnetic induction when an alternating-current voltage is applied from the alternating-current power supply 63B.

The curving member 64 has a function forming the nip N on the heating belt 61 and the pressuring roller 62 by sandwiching the heating belt 61 in cooperation with the pressuring roller 62. The curving member 64 comes, as shown in FIG. 3B, into contact with an inner circumference of the heating belt 61 in a state that the curving member is positioned to face to the pressuring roller 62 across the heating belt 61. A portion of the curving member 64 coming into contact with the inner circumference of the heating belt 61 is depressed in a curved shape toward the pressuring roller 62. The curving member 64 is positioned to the pair of side plates described above.

The guiding part 65 has a function guiding the medium S conveyed along a conveying path P by a conveying device 50 toward the nip N. The guiding part 65 of the present embodiment is, as shown in FIG. 3B, a plate of positioned so that a side of a tip end of the guiding part 65 is inclined from a side of the pressuring roller 62 to a side of the heating belt 61 with respect to the device-height direction. Further, the guiding part 65 is positioned at a lower side of the pressuring roller 62. That is, the guiding part 65 is, as shown in FIG. 3B, positioned at an upstream side of the conveying direction (a direction indicated by an arrow Y in the diagram) of the medium S with respect to the nip N.

The temperature sensor 66 has a function sensing the temperature of the heating belt 61. The temperature sensor 66 is, as shown in FIG. 3B, as one example, positioned at a lower side of the heating belt 61 and faces to the heating belt 61 (the outer circumference of the heating belt 61). Incidentally, the temperature (data about the temperature) sensed by the temperature sensor 66 is transmitted to the controlling part CU at a predetermined cycle.

The corona charging device 68 has a function electrically discharging to electrically charge the heating belt 61 (the release layer 61C of the heating belt 61) with the same polarity as that of the toner (the average charge of the toner), that is, positive polarity. As shown in FIG. 3B, the corona charging device 68 is configured to include the charging device body 70 (one example of a charging part) and a power supply PS. The charging device body 70 has a corotron type configuration electrically charging the heating belt 61 by causing corona discharge phenomenon when a voltage is applied from the power supply PS. The charging device body 70 of the present embodiment has an elongated shape (refer to FIGS. 3A and 3D) and is, as one example, positioned to face to the outer circumference of the heating belt 61 at the downstream side with respect to the induction coil 63A and at the upstream side with respect to the temperature sensor 66 in the rotating direction of the heating belt 61 in a state that the longitudinal direction of the charging device body 70 is arranged along the longitudinal direction (the axial direction of rotation) of the heating belt 61 (refer to FIG. 3A). When viewed from a different angle, the charging device body 70 is positioned to face to a portion at on the outer circumference of the heating belt 61 at the downstream side with respect to the nip N and at the upstream side with respect to the temperature sensor 66 in the rotating direction of the heating belt 61. Further, when viewed from another different angle, the charging device body 70 is, as shown in FIG. 3B, positioned at the opposite side with respect to the guiding part 65 across the temperature sensor 66. Incidentally, the ground terminal (not shown) of the power supply PS described later is connected to the frame (not shown) of the main body of the image forming apparatus 10 and grounded.

The charging device body 70 is, as shown in FIGS. 3B and 3D to 3G, configured to include a discharging electrode 72 and an enclosure wall 74. The discharging electrode 72 is, as one example, an elongated metallic plate and is formed in a serrated shape so that teeth at one end side in the lateral direction thereof are formed and positioned at regular intervals in the longitudinal direction thereof (refer to FIGS. 3D to 3F). When viewed from a different angle, the discharging electrode 72 is an electrode composed of a plurality of needle-shaped electrodes arranged along the longitudinal direction thereof, that is, the longitudinal direction of the heating belt 61 and oriented to the heating belt 61. The enclosure wall 74 is, as one example, an elongated member formed to include a pair of parts at both ends in a thickness direction of the discharging electrode 72 and arranged along the longitudinal direction of the discharging electrode 72 (refer to FIGS. 3B, 3D, 3F and 3G). The enclosure wall 74 is, as one example, composed of a pair of shields 74A and a pair of insulating members 74B. The pair of shields 74A is connected to the ground terminal (not shown) of the power supply PS and connected to the output terminal (not shown) of the power supply PS and has a function producing an electric field between the shields 74A and the discharging electrode 72 to which a voltage with the same polarity as that of the toner (average charge of the toner) is applied. By contrast, the pair of insulating members 74B are respectively disposed between one shield 74A and the discharging electrode 72 and between another shield 74A and the discharging electrode 72 and have a function supporting the discharging electrode 72 across the discharging electrode 72 while being fixed to the respective shields 74A. Incidentally, as described above, the enclosure wall is positioned so as to enclose the discharging electrode 72. Moreover, the pair of insulating members 74B has insulation quality as indicated by its name.

When the enclosure wall 74 is viewed from a different angle, the enclosure wall 74 can be divided into a part at the upstream side and a part at the downstream side in the rotating direction of the heating belt 61 with respect to the discharging electrode 72. In the description later, the part of the enclosure wall 74 at the upstream side and the part of the enclosure walls 74 at the downstream side in the rotating direction of the heating belt 61 with respect to the discharging electrode 72 are respectively called as an upstream side part 80 and a downstream side part 90 (refer to FIGS. 3E and 3G).

Then, in the upstream side part 80 (in the insulating member 74B composing the upstream side part 80), as shown in FIG. 3F, through holes 82 are formed at regular intervals (at the same intervals as those of tooth tips of end portions at one end side of the discharging electrode 72, as one example) along the longitudinal direction thereof, that is, the longitudinal direction of the heating belt 61. Herein, the through holes 82, as shown in FIGS. 3F and 3G, penetrate the insulating member 74B along the lateral direction of the discharging electrode 72 (a direction orthogonal to the longitudinal direction and the thickness direction). Thus, in the charging device body 70, an inside and an outside of the charging device body 70 are communicated with each other by the through holes 82. Moreover, the through holes 82 are, as shown in FIG. 3F, formed and arranged at positions where the tip ends 72A (refer to FIG. 3F) of the discharging electrode 72 are overlapped in the rotating direction of the heating belt 61. Then, the through holes 82 are formed to flow air, which moves from the inside of the charging device body 70 and passes through an opposite section between the discharging electrode 72 and the heating belt 61 in response to the rotation of the heating belt 61, from the outside of the charging device body 70.

In addition, in the downstream side part 90 (in the insulating member 74B composing the downstream side part 90), through holes 92 (one example of another through holes) are formed at regular intervals (at the same intervals as those of the tooth tips of end portions at one end side of the discharging electrode 72, as one example) along the longitudinal direction thereof, that is, the longitudinal direction of the heating belt 61 (refer to FIGS. 3E and 3G). Herein, the through holes 92 penetrate, as shown in FIG. 3G, the insulating member 74B along the lateral direction of the discharging electrode 72. Thus, in the charging device body 70, the inside and the outside of the charging device body 70 are communicated with each other by the through holes 92. Further, the through holes 92 are, as shown in FIG. 3E, formed and arranged at positions shifted to the positions where the tip ends 72A of the discharging electrode 72 are overlapped in the rotating direction of the heating belt 61.

Then, the through holes 92 are formed to flow the air, which moves from the inside of the charging device body 70 and passes through an opposite section between the discharging electrode 72 and the heating belt 61 in response to the rotation of the heating belt 61, from the outside of the charging device body 70. Incidentally, the through holes 82 and the through holes 92 are, as shown in FIG. 3E, formed to be arranged in a staggered manner along the longitudinal direction of the discharging electrode 72 across the discharging electrode 72.

The charging device body 70 of the present embodiment is configured so as to be detachably attached to a fixing device body 60A (as one example, the fixing device body 60A corresponds to a remaining part removing the fixing device 60 from the charging device body 70. Further, the fixing device body 60A corresponds to one example of a device body. Refer to FIG. 3H) (refer to FIGS. 3A and 3H). Specifically, to parts on both end sides in the longitudinal direction of the charging device body 70, as shown in FIG. 3D, resin members 100 (one example of contact prevention members), in which through holes 100A are respectively formed, are fixed. Then, the charging device body 70 is fastened with screws in a state where the respective through holes 100A are overlapped with screw holes (not shown) formed in the fixing device body 60A, and thereby, attached to the fixing device body 60A. Each resin member 100 in a state of being attached to the fixing device body 60A is, as shown in FIG. 3A, positioned at a side of the heating belt 61 with respect to the discharging electrode 72 and the enclosure wall 74 composing the charging device body 70. Each resin member 100 is overlapped with the each pulley PL in the radial direction, but is separated from each pulley PL. Thus, each resin member 100 has a function preventing the enclosure wall 74 from coming into contact with the heating belt 61 when the charging device body 70 is attached or detached to/from the charging device body 70.

In the charging device body 70 of the present embodiment, as shown in FIGS. 3B and 3D, a portion of shield 74A of the upstream side part 80 is bent to the upstream side in the rotating direction of the heating belt 61. Then, in the bent portion of the shield 74A of the upstream side part 80, a handle 74A1 used in attaching or detaching the charging device body 70 to/from the fixing device body 60A is provided.

The blowing fan 69 has a function sending air from the outside of the charging device body 70 into the inside of the charging device body 70 through the through holes 82 and 92 (refer to FIG. 3B) formed in the charging device body 70 (in the insulating member 74B of the charging device body 70). The blowing fan 69 of the present embodiment is, as shown in FIG. 3B, positioned at a lower side and a left side of the charging device body 70 as viewed from the front side.

Next, the fixing operation of the fixing device 60 of the present embodiment will be described with reference to FIGS. 2, 3B, and 4 (mainly FIG. 4).

First, the controlling part CU transmits a remote signal instructing the fixing operation to the fixing device 60 (refer FIG. 2) when receiving image data from an external device (not shown). Then, the controlling part CU drives the driving source (not shown) of the pressuring roller 62, and then, rotates the pressuring roller 62. In accordance with this, the heating belt 61 is rotated by following the pressuring roller 62. The controlling part CU operates the alternating-current power supply 63B of the heating source 63 and causes the alternating-current power supply 63B to apply electric power to the induction coil 63A. According to this, the induction coil 63A applies heat to the heating belt 61 (the heating layer 61A of the heating belt 61) by an action of electromagnetic induction, and then, increases the temperature of the heating belt 61. In such a case, the temperature of the heating belt 61 is sensed by the temperature sensor 66 at a predetermined cycle. The temperature (data about the temperature) sensed by the temperature sensor 66 is transmitted to the controlling part CU at a predetermined cycle (refer to FIG. 2). The controlling part CU causes the alternating-current power supply 63B to adjust the electric power supplied from the alternating-current power supply 63B to the induction coil 63A in a manner that the temperature sensed by the temperature sensor 66 becomes a predetermined temperature.

Next, the controlling part CU operates the corona charging device 68. Specifically, the controlling part CU causes the power supply PS to apply a predetermined direct-current voltage to the discharging electrode 72. According to this, between the discharging electrode 72 and the pair of shields 74A, an electric field attributed to the direct-current voltage having positive polarity, the structure of the charging device body 70 and clearance with respect to the heating belt 61 is produced. As a result, the corona charging device 68 (or the charging device body 70) causes the discharging electrode 72 to electrically discharge so as to electrically charge the heating belt 61 with positive polarity, that is, the same polarity as that of the toner (the average charge of the toner) in a state that the electric field is produced between the discharging electrode 72 and the pair of shields 74A (refer to FIG. 4).

When the entire medium S on which the toner image is formed by the forming part 30A passes through the nip N, the controlling part CU stops the driving source of the pressuring roller 62, the alternating-current power supply 63B of the heating source 63, the power supply PS of the corona charging device 68 and the power supply of the temperature sensor 66 and completes the fixing operation.

Figure 4:
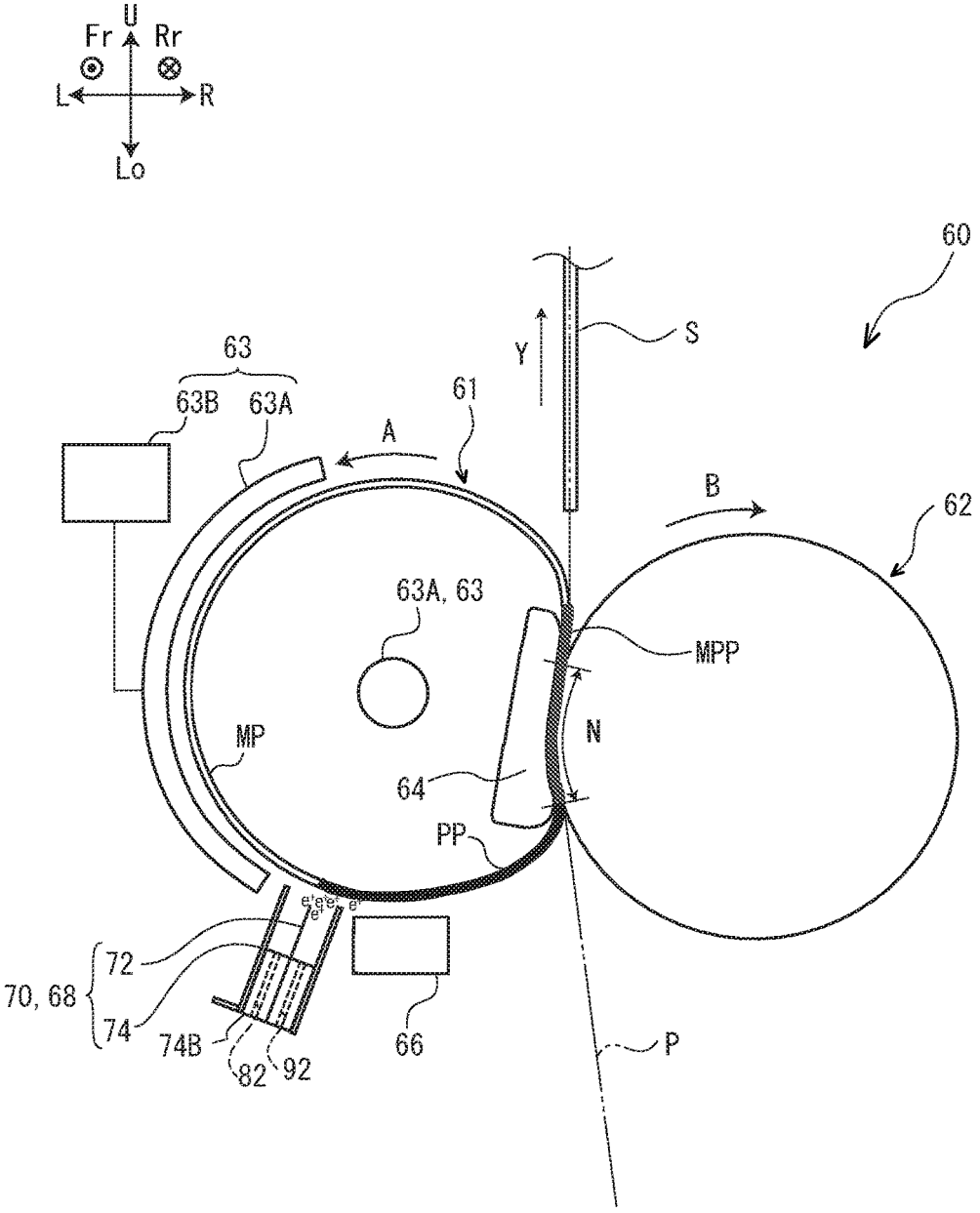
FIG. 4 is a transverse sectional view showing the fixing device, as viewed from the front side, according to the present embodiment, together with charging distribution of the heating belt in fixing operation.

Incidentally, FIG. 4 illustrates charging distribution on various portions of the heating belt 61 rotated by following the pressuring roller 62. A portion (a white portion) pointed by a sign MP is a portion charged with negative polarity on the heating belt 61, and a different portion (a black portion) pointed by a sign PP is a portion charged with positive polarity on the heating belt 61, and a further different portion (a gray portion) pointed by a sign MPP is a portion on which the portion charged with positive polarity is changed with negative polarity, on the heating belt 61. As the charging distribution shown in FIG. 4, a portion of the heating belt 61 passed through the nip N is electrically charged with the negative polarity, the negative polarity is strengthened in comparison with its original state due to contact with the medium S, and subsequently, when this portion moves to a position facing to the charging device body 70 in response to the rotation of the heating belt 61, ions having positive polarity (signs e+ in FIG. 4) electrically discharged by the discharging electrode 72 are adhered to this portion. As a result, the portion pointed by the sign PP, that is, the portion electrically charged with positive polarity is brought on the heating belt 61.

Next, the effects of the present embodiments will be described with reference to drawings.

First, the first effect will be described. For example, in a case (hereinafter, called as a case of a comparison form) of using a fixing device (not shown) having the same configuration as that of the fixing device 60 of the present embodiment except that the arrangement of the charging device body 70 and the temperature sensor 66 is inverted in the fixing device 60 (refer to FIG. 3B) of the present embodiment, ions generated by the electric discharge of the charging device body 70 may be moved by the airflow generated by the rotation of the heating belt 61 to electrically charge the guiding part 65. According to this, the charged guiding part 65 exerts an electrostatic force on the medium S conveyed by the conveying device 50. Then, the medium S conveyed while coming into contact with the charged guiding part 65 may not be guided to the nip N because of an effect of the electrostatic force of the guiding part 65. As a result, the medium S not being guided to the nip N causes guiding failure, such as so-called paper jamming.

Incidentally, in a case of the fixing device 60 of the present embodiment, similarly to the case of the fixing device of the comparison form, ions generated by the electric discharge of the charging device body 70 may be moved by the airflow generated by the rotation of the heating belt 61 to a side of the guiding part 65.

However, in the case of the fixing device 60 of the present embodiment, as shown in FIG. 3B, the charging device body 70 is positioned on an opposite side of the guiding part 65 across the temperature sensor 66. When viewed from a different angle, in the case of the present embodiment, the charging device body 70 faces, as shown in FIG. 3B, a portion on the outer circumference of the heating belt 61 at the downstream side with respect to the nip N and at the upstream side with respect to the temperature sensor 66 in the rotating direction of the heating belt 61. Thus, as the first effect, the airflow generated by the rotation of the heating belt 61 collides with the temperature sensor 66, and then, the velocity of the airflow is reduced. In accordance with this, the ions generated by the electric discharge of the charging device body 70 are hard to move to the side of the guiding part 65, compared with the case of the comparison form.

Therefore, as the first effect, the fixing device 60 of the present embodiment can prevent occurrence of the guiding failure of the medium S attributed to a situation that the guiding part 65 is electrically charged by the charging device body 70, which is electrically charges the heating belt 61 with the same polarity as that of the toner in order to prevent occurrence of electrostatic offset, compared with the fixing device of the comparison form. According to this, the image forming apparatus 10 of the present embodiment can prevent occurrence of image forming failure due to the guiding failure.

Further, in the case of the present embodiment, the induction coil 63A composing the heating source 63 is, as shown in FIG. 3B, formed in an arc shape as viewed from the front side. When viewed from another angle, the induction coil 63A faces to a portion on the outer circumference of the heating belt 61 at the downstream side with respect to the nip N and at the upstream side with respect to the charging device body 70 described later in the rotating direction of the heating belt 61. Thus, the intensity (velocity) of the airflow generated by the rotation of the heating belt 61 in the case of the present embodiment is, for example, stronger (higher) than the airflow generated by the rotation of the heating belt 61 in a case where a means supplying heat to the heating belt 61 is provided in the inside of the heating belt 61. Therefore, as the present embodiment, when the induction coil 63A of the heating source 63 faces to the portion on the outer circumference of the heating belt 61 at the downstream side with respect to the nip N and at the upstream side with respect to the charging device body 70 described later in the rotating direction of the heating belt 61, the aforementioned first effect is noticeably brought to the fore.

Next, the second effect will be described. For example, in a case (hereinafter, called as a case of another comparison form) of using a fixing device (refer to FIG. 5) having the same configuration as that of the fixing device of the present embodiment except that the through holes 82 and 92 are formed in the enclosure wall 74, when the medium S on which the toner image is formed passes through the nip N, impurities caused by the medium S are moved to the charging device body 70 by airflow AF1 generated by the rotation of the heating belt 61. Then, the impurities moved by the airflow AF1 to the charging device body 70 may enter the charging device body 70 with the airflow AF1 and be adhered to the discharging electrode 72. As a result, it is feared that electric discharge with respect to the heating belt 61 (in the axial direction of the heating belt 61) by the charging device body 70 becomes non-uniformity by adhesion of impurities, and then, a discharging state is destabilized from a long term view. Further, it is feared that this leads to fixing failure.

Figure 6:
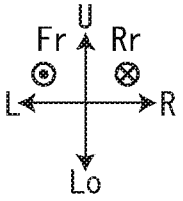
FIG. 6 is a transverse sectional view showing the fixing device according to the embodiment, together with airflow generated in the periphery of the charging device body in the fixing operation.
Figure 6:
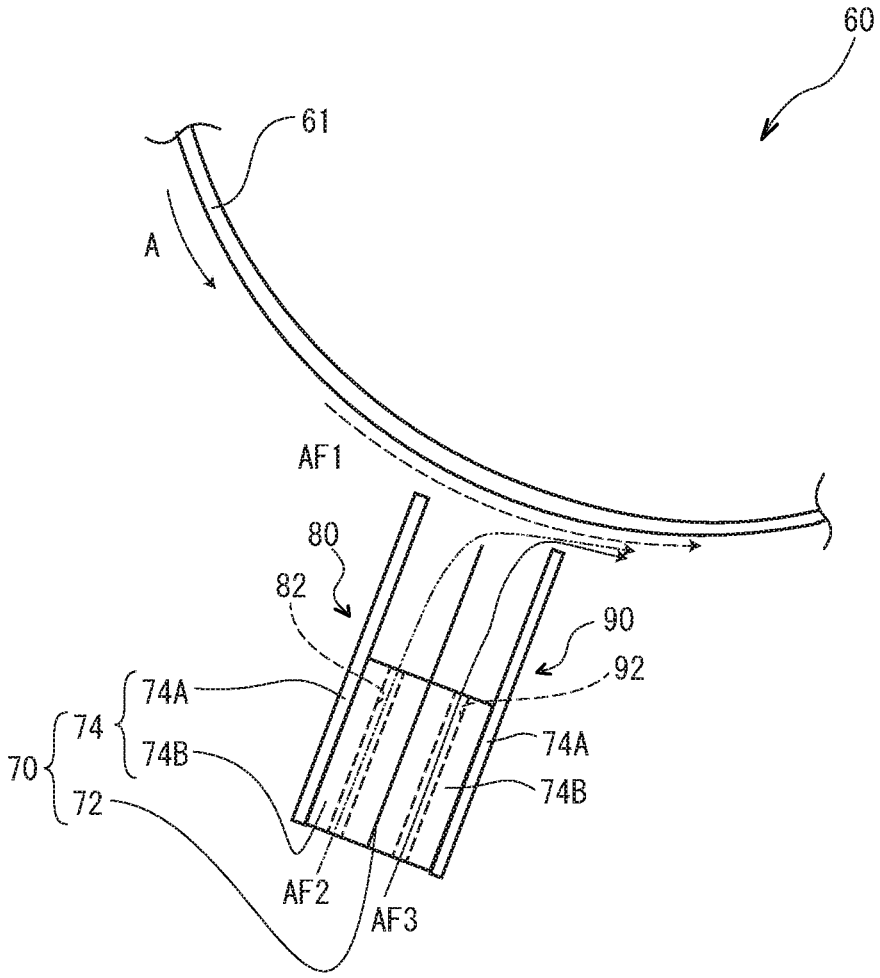

In the case of the present embodiment, as shown in FIG. 6, similarly to another comparison form described above, when the medium S on which the toner image is formed passes through the nip N, impurities caused by the medium S may be moved by the airflow AF1 generated by the rotation of the heating belt 61 to the charging device body 70.

However, in the fixing device 60 of the present embodiment, as shown in FIGS. 3E, 3G and 6, the through holes 82 are formed in the upstream side part 80 of the enclosure wall 74. Thus, in the case of the present embodiment, when the airflow AF1 passes through an opposite section between the charging device body 70 and the heating belt 61, air (airflow AF2) flows from the outside of the charging device body 70 to the inside of the charging device body 70 via the through holes 82 into the charging device body 70 and passes through the tip end 72A of the discharging electrode 72, that is, through the opposite section between the charging device body 70 and the heating belt 61. As a result, in the case of the present embodiment, as the second effect, impurities caused by the medium S at the nip N and moved to the charging device body 70 by the airflow AF1 are hard to enter the charging device body 70 with the airflow AF1, compared with the case of another comparison form described above. According to this, in the case of the present embodiment, a quantity of impurities caused by the medium S at the nip N, moved to the charging device body by the airflow AF1 and adhered to the discharging electrode 72 is less, compared with the case of another comparison form described above.

Therefore, as the second effect, the fixing device 60 of the present embodiment can stabilize the discharge state (the uniformity of electric discharge in the longitudinal direction of the discharging electrode 72) of the charging device body 70, which electrically charges the heating belt 61 with the same polarity as that of the toner in order to prevent occurrence of electrostatic offset, for a long term, compared with the fixing device of another comparison form described above. Moreover, the image forming apparatus 10 of the present embodiment can prevent image forming failure caused by the destabilization of the discharge state of the charging device body 70.

Further, the third effect will be described. In the present embodiment, the through holes 82 are, as shown in FIG. 3E, formed and arranged on the upstream side part 80 of the enclosure wall 74 at plural positions along the longitudinal direction of the discharging electrode 72 and at positions where the tip ends 72A of the discharging electrode 72 are overlapped in the rotating direction of the heating belt 61.

Thus, in the fixing device 60 of the present embodiment, as the third effect, the airflow AF2 entering the charging device body 70 through the through holes 82 is easy to pass through the tip end 72A, compared with a case where the through holes 82 are formed and arranged at positions shifted to positions at which the tip ends 72A of the discharging electrode 72 are overlapped in the rotating direction of the heating belt 61.

Therefore, as the third effect, the fixing device 60 of the present embodiment can stabilize the discharge state of the charging device body 70 for a long term, compared with the case where the through holes 82 are formed and arranged at positions shifted to the positions at which the tip ends 72A of the discharging electrode 72 are overlapped in the rotating direction of the heating belt 61.

Further, the fourth effect will be described. The fixing device 60 of the present embodiment includes, as shown in FIG. 3B, the blowing fan 69 sending air for flowing from the outside of the charging device body 70 into the inside of the charging device body 70 through the through holes 82 and 92 formed in the charging device body (in the insulating member 74B of the charging device body 70). Thus, as the fourth effect, the intensity (velocity) of the airflow AF2 and AF3 flowing through the through holes 82 and 92 into the charging device body 70 in the case of the present embodiment is stronger (higher) than the intensity (velocity) of the airflow AF2 and AF3 flowing through the through holes 82 and 92 into the charging device body 70 in a case not including the blowing fan 69.

Therefore, as the fourth effect, the fixing device 60 of the present embodiment can stabilize the discharge state of the charging device body 70 for a long term, compared with the case not including the blowing fan 69.

Further, the fifth effect will be described. In the fixing device 60 of the present embodiment, as shown in FIGS. 3A and 3H, the charging device body 70 is detachably attached to the fixing device body 60A. Thus, as the fifth effect, the fixing device 60 of the present embodiment can allow the maintenance with the charging device body 70 detached from the fixing device body 60A. Further, in the case of the present embodiment, even when the charging device body 70 is damaged, the charging device body 70 can be replaced with another one.

Further, the sixth effect will be described. In the fixing device 60 of the present embodiment, as shown in FIGS. 3A and 3H, the handle 74A1 used in attaching or detaching the charging device body 70 to/from the fixing device body 60A is provided in the charging device body 70. Thus, as the sixth effect, in the case of the fixing device 60 of the present embodiment, an operator can easily detach the charging device body 70 from the fixing device body 60A.

Further, the seventh effect will be described. In the fixing device 60 of the present embodiment, as shown in FIGS. 3A, 3D and 3I, the pair of pulleys PL are positioned on both ends of the heating belt 61 and the resin members 100 overlapped in the radial direction of the respective pulleys PL are provided on both end sides of the charging device body 70. As shown in FIG. 3A, each resin member 100 in a state of being attached to the fixing device body 60A is positioned at a side of the heating belt 61 with respect to the discharging electrode 72 and the enclosure wall 74 composing the charging device body 70. Then, each resin member 100 is overlapped with each pulley PL in the radial direction, but is separated from each pulley PL. Thus, as the seventh effect, in the case of the fixing device 60 of the present embodiment, when an operator attach or detach the charging device body 70 to/from the fixing device body 60A, each resin member 100 prevents the enclosure wall 74 from coming into contact with the heating belt 61 (each resin member 100 makes the heating belt 61 hard to come into contact with the enclosure wall 74). That is, in the case of the fixing device 60 of the present embodiment, the operator can attach or detach the charging device body 70 to/from the fixing device body 60A without bringing the charging device body 70 into contact with the heating belt 61.

As described above, the embodiment above has been described as one example of the present disclosure, but the technical scope of the present disclosure is not limited to the embodiment above. For example, the technical scope of the present disclosure includes the following form.

For example, the present embodiment described that the controlling part CU is not component of the fixing device 60. However, a part of the controlling part CU controlling the fixing device 60 may be configured as a part of the fixing device 60.

The present embodiment is described that one example of the heating body is the heating belt 61 and one example of the pressuring body is the pressuring roller 62. However, for example, as one example of the heating body, another component having a function heating the medium S while rotating may be applied in place of the heating belt 61. For example, one example of the heating body may be a roller (a heating roller). Further, as one example of the pressuring body, another component having a function forming the nip N in cooperation with the heating body while rotating and a function pressuring the medium S passing through the nip N in cooperation with the heating body may be applied in place of the pressuring roller 62. For example, one example of the pressuring body may be an endless belt (a pressuring belt).

The present embodiment is described that the heating belt 61 receives heat from the induction coil 63A of the heating source 63 positioned to face to the outer circumferential face of the heating belt 61. However, a main part of another heating source 63 supplying heat to the heating belt 61 may be positioned inside the heating belt 61. In such a case, the main part may be a main part of a bar-shaped filament lamp or another heat source.

Further, the present embodiment is described that the through holes 92 are formed in the downstream side part 90 of the enclosure wall 74 (refer to FIG. 3E). However, as long as the through holes 82 are formed in the upstream side part 80 of the enclosure wall 74, the through holes 92 may not be formed in the downstream side part 90.

Further, the present embodiment is described that the plurality of through holes 82 are formed in the upstream side part 80 of the enclosure wall 74 and arranged along the longitudinal direction of the discharging electrode 72 (refer to FIG. 3E). However, as long as the through hole 82 is formed in the upstream side part 80 of the enclosure wall 74, the plurality of through holes 82 may not be formed in the upstream side part 80 (it is sufficient that single through hole 82 is formed in the upstream side part 80).

Further, the present embodiment is described that the plurality of through holes 82 are formed in the upstream side part 80 of the enclosure wall 74 and each through hole 82 is formed at a position where the tip end 72A of the discharging electrode 72 is overlapped in the rotating direction of the heating belt 61 (refer to FIG. 3E). However, as long as single through hole 82 or plural through holes 82 is/are formed in the upstream side part 80 of the enclosure wall 74, each through hole 82 may not be overlapped with the tip end 72A of the discharging electrode 72 in the rotating direction of the heating belt 61.

Further, the present embodiment is described that the through holes 82 are formed in the insulating member 74B of the enclosure wall 74 (refer to FIG. 3E). However, the through holes 82 may be formed in the shield 74A of the upstream side part 80.

Incidentally, the above-description of the embodiments was described about one example of the fixing device and the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. A fixing device comprising:

a heating body formed in a tube shape and, while rotating, heating a medium conveyed after a toner image is formed on the medium;

a pressuring body formed in a tube shape and, while rotating, forming a nip in cooperation with the heating body and pressuring the medium by sandwiching the medium in cooperation with the heating body at the nip;

a heating source supplying the heating body heat used when the heating body heats the medium;

a guiding part positioned upstream from the nip in a conveying direction of the medium and guiding the medium being conveyed to the nip;

a temperature sensing part positioned to face to the heating body and sensing a temperature of the heating body; and a charging part positioned at an opposite side of the temperature sensing part from the guiding part, being configured as a corotron type charging part electrically discharging to electrically charge the heating body with the same polarity as polarity of toner, and including: a discharging electrode electrically discharging toward the heating body facing to the discharging electrode; and an enclosure wall supporting the discharging electrode, enclosing the discharging electrode and producing an electric field in cooperation with the discharging electrode, wherein the charging part is detachably attached to a device body, the heating body is an endless belt, the fixing device further comprises:

a pair of pulleys positioned at both end sides in a longitudinal direction of the belt and preventing the belt from weaving, at both end sides in a longitudinal direction of the charging part, contact prevention members are provided so as to prevent the enclosure wall from coming into contact with the belt when the charging part is attached or detached to/from the device body.

2. The fixing device according to claim 1, wherein in a rotating direction of the heating body, the temperature sensing part faces to a portion downstream from the charging part and upstream from the nip on an outer circumference of the heating body.

3. An image forming apparatus comprising:

a forming part forming a toner image onto a medium; and the fixing device according to claim 2 fixing the toner image formed on the medium by the forming part onto the medium.

4. The fixing device according to claim 1, wherein the heating source faces to a portion downstream from the nip and upstream from the charging part on an outer circumference of the heating body in a rotating direction of the heating body.

5. An image forming apparatus comprising:

a forming part forming a toner image onto a medium; and the fixing device according to claim 4 fixing the toner image formed on the medium by the forming part onto the medium.

6. The fixing device according to claim 1, wherein in the enclosure wall, a through hole is formed so as to flow air, which moves from an inside of the charging part in response to rotation of the heating body and passes through an opposite section between the discharging electrode and the heating body, from an outside of the charging part.

7. The fixing device according to claim 6 further comprising:

a blowing part sending air from the outside of the charging part into the through hole.

8. An image forming apparatus comprising:

a forming part forming a toner image onto a medium; and the fixing device according to claim 7 fixing the toner image formed on the medium by the forming part onto the medium.

9. The fixing device according to claim 6, wherein the discharging electrode is formed in a serrated shape so that teeth are formed at regular intervals in a longitudinal direction of a belt, the through hole is formed and arranged so as to be overlapped with a tip end of the discharging electrode.

10. An image forming apparatus comprising:

a forming part forming a toner image onto a medium; and the fixing device according to claim 9 fixing the toner image formed on the medium by the forming part onto the medium.

11. An image forming apparatus comprising:

a forming part forming a toner image onto a medium; and the fixing device according to claim 6 fixing the toner image formed on the medium by the forming part onto the medium.

12. The fixing device according to claim 1, wherein in the enclosure wall, a handle used in attaching or detaching the charging part to/from the device body is provided.

13. An image forming apparatus comprising:

a forming part forming a toner image onto a medium; and the fixing device according to claim 12 fixing the toner image formed on the medium by the forming part onto the medium.

14. The fixing device according to claim 1, wherein the contact prevention members are separated from the pair of pulleys in a state that the charging part is attached to the device body.

15. An image forming apparatus comprising:

a forming part forming a toner image onto a medium; and the fixing device according to claim 14 fixing the toner image formed on the medium by the forming part onto the medium.

16. An image forming apparatus comprising:

a forming part forming a toner image onto a medium; and the fixing device according to claim 1 fixing the toner image formed on the medium by the forming part onto the medium.

* * * * *